United States Patent [19]

Wada

[11] Patent Number: 5,054,010

[45] Date of Patent: Oct. 1, 1991

[54] TABLE CLOCK

[75] Inventor: Mitsuo Wada, Tokyo, Japan

[73] Assignee: Seikosha Co., Ltd., Japan

[21] Appl. No.: 444,630

[22] Filed: Dec. 1, 1989

[30] Foreign Application Priority Data

Dec. 2, 1988 [JP] Japan ..... 63-157318[U]

[51] Int. Cl.[5] ..... G04B 37/00

[52] U.S. Cl. ..... 368/276; 368/316

[58] Field of Search ..... 368/88, 276, 284, 316–317

[56] References Cited

U.S. PATENT DOCUMENTS

| | | | |
|---|---|---|---|
| 1,853,483 | 4/1932 | Winters | 368/316 |
| 4,491,425 | 1/1985 | Young-Koo | 368/317 |
| 4,747,088 | 5/1988 | Suzuki | 368/316 |

FOREIGN PATENT DOCUMENTS

| | | | |
|---|---|---|---|
| 0290935 | 11/1988 | European Pat. Off. | 368/316 |
| 2054274 | 2/1981 | United Kingdom | 368/316 |

*Primary Examiner*—Vit W. Miska

*Attorney, Agent, or Firm*—Bruce L. Adams; Van C. Wilks

[57] ABSTRACT

A table clock capable of changing its attitude in use.

According to one embodiment of the invention, the table clock is attached with at least two pedestals which are slidably fitted on the outer periphery of the casing of the clock so that when in use, the clock can be placed on a table or desk at a desired angle of inclination according to the user's liking by moving the pedestals to desired positions, respectively.

7 Claims, 4 Drawing Sheets

TABLE CLOCK

BACKGROUND OF THE INVENTION

The present device relates to a table clock.

Description of the Prior Art

Of the conventional table clocks whose attitude can be changed, there has been the type like a portable clock comprising a main body and a pedestal whose one end is attached to the main body so as to move freely with respect to the latter so that the main body can be placed on a table or desk upright or at a desired angle of inclination by adjusting the angle of inclination of the pedestal.

However, the above type of clock has had the disadvantages that since the attitude of the clock is changed by adjusting the angle of inclination of the single pedestal, it is not possible to keep the clock turned sideways by adjusting the pedestal thereby failing to satisfy all the placing conditions demanded by the user and moreover, it is not attractive in view of its design.

SUMMARY OF THE INVENTION

An object of the present invention is to provide a table clock whose design is attractive and whose attitude can be changed at a desired angle of inclination according to the user's liking.

The table clock according to the present invention is charaterized in that it comprises a main clock body contained in a smooth casing and at least two frictionally movable pedestals attached to the outer periphery of the casing with the rear end of each of the pedestals projecting rearwardly of the rear surface of the casing so that the attitude of the clock can be changed at a desired angle of inclination with respect to the table or desk on which it is placed.

DETAILED DESCRIPTION OF THE INVENTION

One embodiment of the present invention will now be described with reference to the accompanying drawings.

Figure 1:
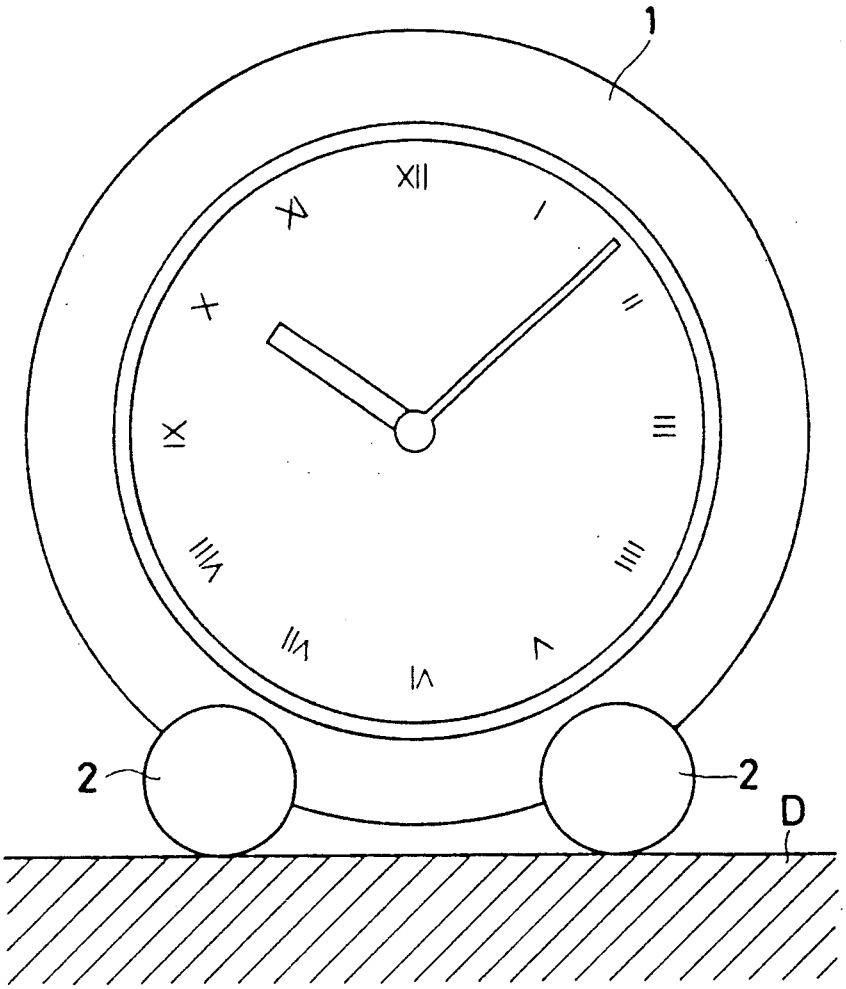
FIG. 1 is a front view of a table clock according to the present invention especially when the clock is erected upright on a desk.

In FIG. 1, the outer periphery of a cylindrical casing 1 of a table clock has a smooth surface and a uniform width throughout it and two pedestals 2, 2 are slidably attached thereto in a friction fit.

Figure 2:
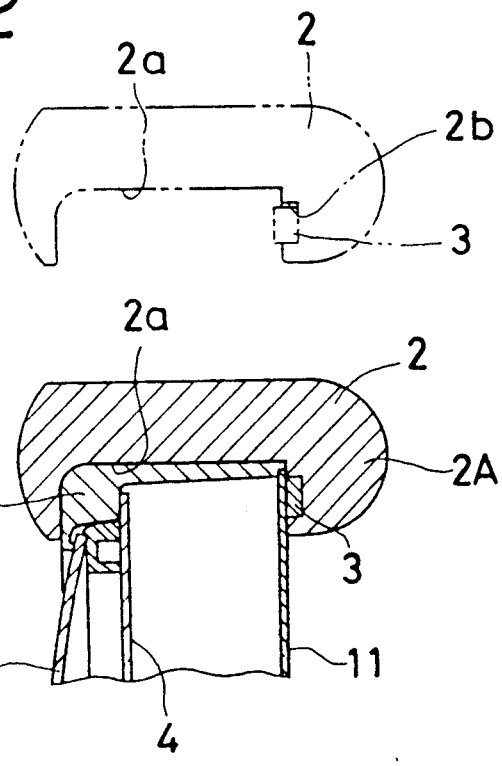
FIG. 2 is a sectional view illustrating how each of two pedestals is attached to the clock of FIG. 1.

As shown in FIG. 2, each of the supporting means or pedestals 2, 2 is cylindrical with both end surfaces thereof being shaped semicircular and has an engaging groove 2*a* at one side thereof. The internal surface of the engaging groove 2*a* is so shaped as to mate with the outer periphery of the casing 1 and provided at one end portion thereof with a hole 2*b* having an elastic member 3 inserted therein. Accordingly, to attach each of the pedestals 2, 2 to the clock, the elastic member 3 is first fitted into the hole 2*b* of the pedestal 2 and fixed thereto by using an adhesive as shown by the chain line of FIG. 2 and the pedestal 2 is fitted on the outer periphery of the casing 1 as shown by the solid line of the same figure whereby the pedestal 2 is slidably retained by the casing 1. By the way, the pedestals 2, 2 may be made of an elastic resin material and the engaging groove 2*a* of each of the pedestals may be formed somewhat smaller in width than the mating outer periphery of the casing 1 so that the former is elastically fitted on the latter. Thus, with the above arrangement, each pedestal 2 can frictionally slide along the outer periphery of the casing 1.

Figure 4:
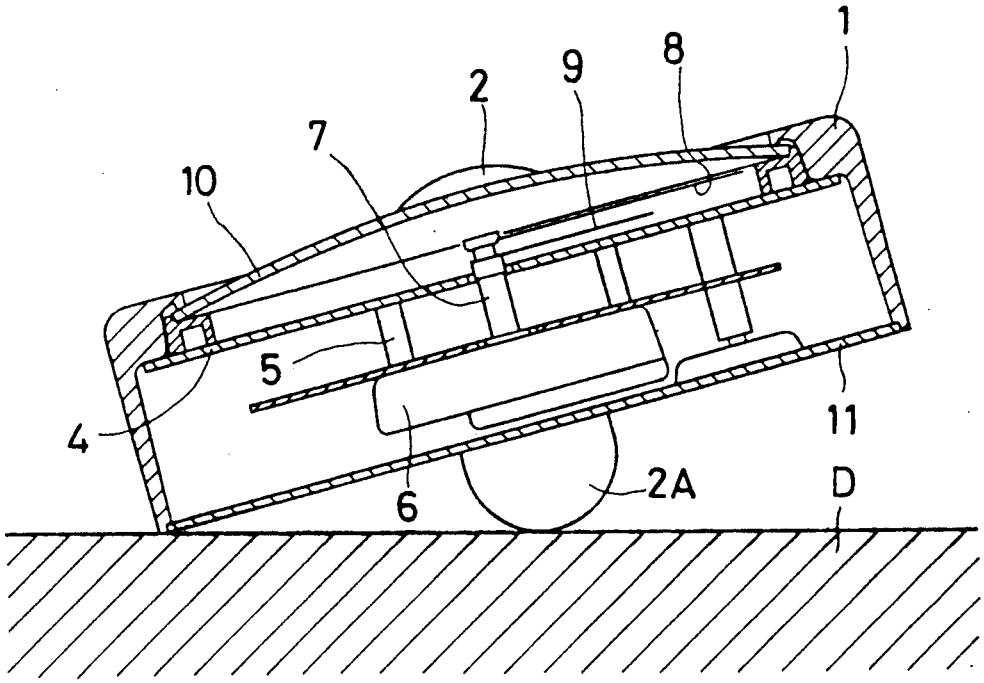
FIG. 4 is a sectional view taken along the a—a line of FIG. 3.

Further, the structure of the inside of the casing 1 is such that as shown in FIG. 4, a fitting plate 4 for a movement 6 of the clock is fixed to the casing 1, a dial is applied to the front surface of the fitting plate 4 and the movement 6 is attached to the rear surface of the fitting plate 4 by means of supports 5, 5. In addition, a minute hand 8 and an hour hand 9 are fixed to a hand shaft 7 projecting from the movement 6 and in front of the hands 8 and 9 there is a front cover 10 which is held fixed to the inner periphery of the casing 1 while a lid 11 is attached to the rear side of the casing 1 so as to close a rear open end of the casing.

A rear end 2A of each of the pedestals 2, 2 projects rearwardly of the lid 11 as shown in FIGS. 2 and 4 when the pedestals have been attached to the casing 1.

Next, the manner of using the clock will be described.

Where it is desired to erect the clock upright on a desk D, one may set the pedestals 2, 2 to the lower part of the casing 1, for example, to positions corresponding to five and seven o'clock positions, respectively, of the time graduations on the dial as shown in FIG. 1.

Figure 3:
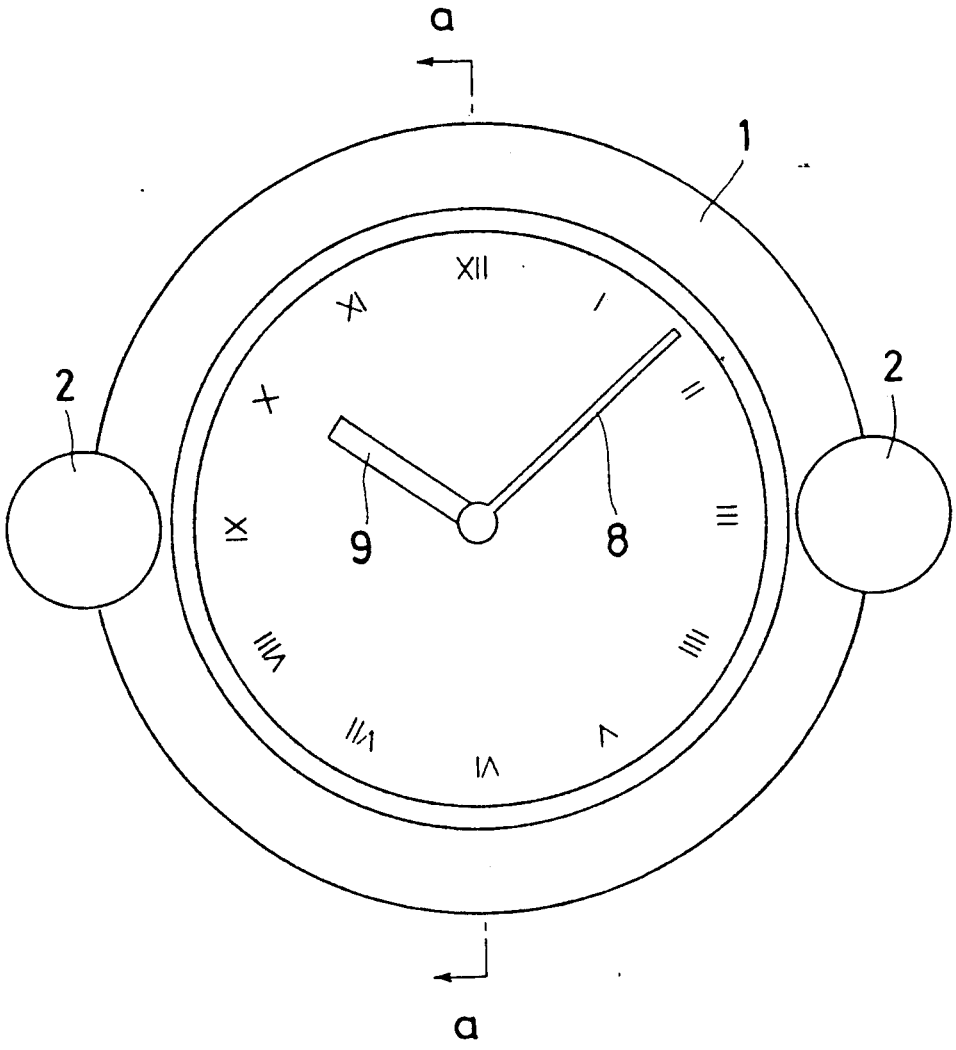
FIG. 3 is a front view of the clock especially when the clock is laid down on the desk.

Further, where it is desired to lay the clock down the clock, one may set the pedestals 2, 2 to both side portions of the casing 1, respectively, for example, to positions corresponding to three and nine o'clock positions of the time graduations on the dial as shown in FIG. 3 whereby the clock is held inclined slightly by the degree to which the rear end 2A of each of the pedestals 2, 2 projects rearwardly of the rear end surface of the casing 1 as shown in FIG. 4.

It is also possible to erect the clock with the dial turned sideways by setting both of the pedestals to one side of the casing 1.

Where the pedestals 2, 2 are not used, they may be removed from the casing 1.

It should be noted that although the casing 1 in the instant embodiment is described as circular, it may be elliptical or partially include a flat or curved portion.

Moreover, the number of pedestals may be increased as the case may be so that the clock may be used otherwise according to one's desired purposes.

As described above, the advantages of the clock of the present device are in that since the casing 1 of the clock is attached with at least two pedestals which are frictionally retained by, and movable along, the outer periphery thereof with the rear end of each of the pedestals projecting rearwardly of the casing 1, the clock can be placed in a variety of attitudes according to the user's liking by merely moving the pedestals and that since the clock has an attractive design, it can be used for a display purpose.

What is claimed is:

1. A table clock comprising: a casing, a timepiece movement disposed in the casing, and at least two pedestals attached to an outer periphery of said casing, each of said pedestals being slidably retained on said casing with a rear end thereof projecting rearwardly of a rear surface of said casing so that the attitude of the clock may be optionally changed.

2. A timepiece adjustable to different angles of inclination relative to a supporting surface, comprising: a timepiece casing; timekeeping means disposed within the casing; and adjustably positionable supporting means slidable along an outer periphery of the casing to different positions for supporting the casing at different angles of inclination relative to a supporting surface, the supporting means comprising at least two pedestals slidable along and frictionally engageable with the casing outer periphery for supporting the casing at different angles of inclination depending on the positions of the pedestals on the casing.

3. A timepiece according to claim 2; wherein the pedestals project rearwardly from the casing, the rearward ends of the pedestals coasting with the rear of the casing to support the casing at different angles of inclination relative to the supporting surface.

4. A timepiece according to claim 3; wherein the rearward ends of the pedestals have a curved shape.

5. A timepiece according to claim 2; wherein each of the pedestals has a groove, the groove slidably receiving therein the casing outer periphery to mount the pedestal for sliding movement along the casing.

6. A timepiece according to claim 5; wherein each of the pedestals has means for elastically urguing the pedestal into sliding frictional contact with the casing.

7. A timepiece according to claim 6; wherein the means for elastically urging comprises an elastic member affixed to each pedestal in the groove thereof, the elastic member elastically urging the pedestal into sliding frictional contact with the casing.

* * * * *